US011536549B1

(12) United States Patent
Kim et al.

(10) Patent No.: US 11,536,549 B1
(45) Date of Patent: Dec. 27, 2022

(54) PORTABLE APPARATUS AND METHOD FOR DISPOSING OF EXPLOSIVE DEVICES

(71) Applicant: The United States of America as Represented by the Secretary of the Navy, Indian Head, MD (US)

(72) Inventors: Steven Kim, Crofton, MD (US); Carl Gotzmer, Accokeek, MD (US); Jason Bruce, Montpelier, VA (US)

(73) Assignee: The United States of America as represented by the Secretary of the Navy, Washington, DC (US)

( * ) Notice: Subject to any disclaimer, the term of this patent is extended or adjusted under 35 U.S.C. 154(b) by 47 days.

(21) Appl. No.: 17/300,395

(22) Filed: Jun. 14, 2021

(51) Int. Cl.
*F42B 33/06* (2006.01)
*F23G 5/40* (2006.01)
*F23G 5/36* (2006.01)

(52) U.S. Cl.
CPC ..... *F42B 33/067* (2013.01); *F23G 5/36* (2013.01); *F23G 5/40* (2013.01)

(58) Field of Classification Search
CPC ..... F42B 33/06; F42B 33/062; F42B 33/065; F42B 33/067
USPC ..... 86/50
See application file for complete search history.

(56) References Cited

U.S. PATENT DOCUMENTS 2,340,945 A * 2/1944 Ellick ..... A62C 3/06 239/408
3,027,445 A * 3/1962 Johnson ..... F23G 5/10 219/50
3,820,479 A * 6/1974 Fylling ..... F42B 39/14 109/1 R
5,791,266 A * 8/1998 Fleming ..... F23J 11/00 110/235
5,864,767 A * 1/1999 Drumgoole ..... F42D 5/045 86/50
5,936,184 A * 8/1999 Majerus ..... F41H 11/12 102/306
5,979,290 A * 11/1999 Simeone ..... F41H 11/16 89/1.13
6,402,864 B1 * 6/2002 Gill ..... C06B 45/00 149/19.9
6,439,120 B1 * 8/2002 Bureaux ..... F42D 5/045 102/303
6,595,247 B1 * 7/2003 Landy ..... F42B 39/14 454/56
6,813,986 B1 * 11/2004 Tafoya ..... F42D 5/045 86/50
7,685,923 B1 * 3/2010 Payne ..... F41H 5/0492 89/36.02
8,616,131 B2 * 12/2013 Kaddour ..... F42B 39/14 102/377

(Continued)

*Primary Examiner* — Derrick R Morgan
(74) *Attorney, Agent, or Firm* — Fredric J. Zimmerman

(57) ABSTRACT

A portable apparatus for incinerating matter in situ includes a container defining an open base and an interior incineration chamber. The open base has a perimeter lying in a single plane. A plurality of ignitable incendiary devices are mounted in the interior incineration chamber above the open base and around a perimeter of the interior incineration chamber. The ignitable incendiary devices are oriented such that flames produced by the incendiary devices are directed inwardly towards a central axis of the incineration chamber. The incendiary devices surround and point toward the matter to be incinerated.

20 Claims, 10 Drawing Sheets

(56) References Cited

U.S. PATENT DOCUMENTS

| | | | | |
|---|---|---|---|---|
| 8,621,973 | B2 | 1/2014 | Abbe et al. | |
| 10,344,973 | B1 | 7/2019 | Gotzmer et al. | |
| 2008/0236375 | A1* | 10/2008 | Lacombe | F42D 5/045 86/50 |
| 2020/0003533 | A1* | 1/2020 | Wilson | F42B 33/067 |

* cited by examiner

PORTABLE APPARATUS AND METHOD FOR DISPOSING OF EXPLOSIVE DEVICES

STATEMENT OF GOVERNMENT INTEREST

The invention described herein may be manufactured and used by or for the Government of the United States of America for Governmental purposes without the payment of any royalties thereon or therefor.

FIELD OF THE INVENTION

The invention relates in general to neutralizing unexploded ordnance (UXO) and Improvised Explosive Devices (IEDs) and in particular to neutralizing Chemical/Biological Improvised Explosive Devices (CBIEDs).

BACKGROUND OF THE INVENTION

During military combat operations, enemy combatants and terrorists frequently use IEDs against troops and vehicles. Such devices also may be used against civilians by domestic terrorists and/or criminals. IEDs are typically constructed of conventional military explosives such as mines, artillery rounds, grenades, dynamite and other explosive material such as C2 explosives. Other nonmilitary grade explosives or pyrotechnic materials can be used as well. IEDs typically may be used as roadside bombs that are detonated by wireless devices such as cell phones or handheld transmitters. Biological agents also may be used in combination with an IED to affect dispersal of vector-borne biological agents for the purpose of creating a patho-physiological toxic effect. Chemical agents also may be used in combination with an IED to affect dispersal of harmful chemical agents. Military troops in the field as well as law enforcement personnel are frequently tasked with locating IEDs and disposing of them. However, once the IEDs are located, it may be difficult, tedious, time consuming and dangerous to transport the IED to another location for disposal.

Some conventional technology use a heavy incineration apparatus that is transported via a truck or other vehicle to the general area of the threat. Once at the general area of the threat, the IED or CBIED or other threat is physically moved from its original location and placed inside the incineration apparatus for neutralization. The process of moving the IED from its original location and placing the IED in the incineration apparatus may be fraught with danger. The IED may explode and injure or kill personnel and/or destroy property including expensive robotic equipment. If toxic biological and chemical agents are present in the IED, then the IED also may release these agents into the surrounding area.

An ignitable incendiary material used in conventional technology is disclosed in U.S. Pat. No. 6,402,864 issued on Jun. 11, 2002 to Gill et al. Gill et al. disclose a mixture containing titanium, boron, polytetrafluoroethylene (Teflon®) and carboxyl-terminated acrylonitrile binder (CTBN). The polytetrafluoroethylene acts as an oxidizer. This mixture is known as "Vulcan Fire powder" and will be referred to as such in this patent application. U.S. Pat. No. 6,402,864 is expressly incorporated by reference herein.

A need exists for a portable apparatus for safely incinerating IEDs, biological and chemical agents and other explosive devices in their original location (in situ).

SUMMARY OF THE INVENTION

In a first aspect, and exemplary embodiment, a portable apparatus for incinerating matter in situ includes a container defining an open base and an interior incineration chamber. The open base may have a perimeter lying in a single plane. A plurality of ignitable incendiary devices are mounted in the interior incineration chamber above the open base and around a perimeter of the interior incineration chamber. The plurality of ignitable incendiary devices are oriented such that flames produced by the incendiary devices are directed inwardly towards a central axis of the incineration chamber. The plurality of incendiary devices surround and point toward the matter to be incinerated.

Each of the plurality of ignitable incendiary devices may include a first casing containing Vulcan Fire powder.

In some exemplary embodiments, each of the incendiary devices may further include an oxidizer in a second casing surrounding the first casing.

The apparatus may include third casings filled with oxidizer where the third casings are interspersed between the plurality of incendiary devices.

The plurality of incendiary devices may be pointed in a direction parallel to the single plane of the open base. In some exemplary embodiments, the plurality of incendiary devices are pointed in a direction that is angled upward with respect to the single plane of the open base. In some exemplary embodiments, some of the plurality of incendiary devices are pointed in a direction parallel to the single plane of the open base and a remainder of the plurality of incendiary devices are pointed in a direction that is angled upward with respect to the single plane of the open base.

The apparatus may include a plate fixed to the container where the plurality of ignitable incendiary devices are mounted to the plate. The plate may have an annular shape in the shape of the perimeter of the open base. The opening of the annular shape may be centered on the central axis of the interior incineration chamber.

In another aspect, a method of incinerating matter in situ includes providing a container defining an open base and an interior incineration chamber. The open base may have a perimeter lying in a single plane. A plurality of ignitable incendiary devices are mounted in the interior incineration chamber above the open base and around a perimeter of the interior incineration chamber. The plurality of ignitable incendiary devices are oriented such that flames produced by the incendiary devices are directed inwardly towards a central axis of the incineration chamber. The open base of the container is placed over the material to be incinerated in situ such that the central axis of the chamber intersects the material to be incinerated.

The method includes igniting the plurality of ignitable incendiary devices and incinerating the matter to be incinerated in situ.

The invention will be better understood, and further aspects, objects, features, and advantages thereof will become more apparent from the following description of the exemplary embodiments, taken in conjunction with the accompanying drawings.

BRIEF DESCRIPTION OF THE DRAWINGS

In the drawings, which are not necessarily to scale, like or corresponding parts are denoted by like or corresponding reference numerals.

DETAILED DESCRIPTION OF THE INVENTION

Apparatus and methods are disclosed for neutralizing explosive threats such as IEDs and CBIEDs in situ via incineration. The ability to incinerate a threat in situ without moving the threat from its original location greatly decreases the dangers associated with moving threats such as, for example, explosive matter, UXO, IEDs and CBIEDs.

A portable apparatus for incinerating a threat in situ has the general form of an open-ended container. The open end of the container is placed over the threat to be incinerated at the location where the threat is found, without moving the threat. The container includes a plurality of ignitable incendiary devices that are pointed toward a central axis of the container. The container is placed over the threat such that the threat is on or adjacent the central axis of the container. The incendiary devices may be casings packed with incendiary material such as Vulcan Fire powder that burns at an extremely high temperature (4,000-7,000 F) to incinerate the threat. The casings may be made of plastic, for example. The extremely high temperatures created by combustion of Vulcan Fire powder have been found sufficient to defeat weaponized biological and chemical threats.

Optionally, an oxidizer such as lithium perchlorate may be placed in the casings with the VF powder or may be placed in casings that are adjacent to the casings containing the VF powder. Thermite may be used to ignite the VF powder. The thermite may be needed on only one or two casings of VF powder in the container which will then ignite the other casings of VF powder. The thermite may be ignited by an electrical signal sent via an initiator wire extending from the thermite to an area external to the container.

As used herein, the term "electrical signal" includes AC (alternating current) signals, DC (direct current) voltages, pulses or pulsed waveforms and radio frequency (RF) signals. The electrical signal is sent to an electrically initiated ignitor. In some exemplary embodiments, an ignitable incendiary device may be remotely ignited. In such an embodiment, an ignitable incendiary device has electrical circuitry that receives an RF (radio frequency) signal through an antenna wire that extends through a through-hole in the container. In response, the electrical circuitry generates an electrical signal that causes ignition of the ignitable incendiary device. The RF signal may be generated and transmitted by, for example, a handheld transmitter, a smart phone or a VHF or UHF transceiver.

Figure 1A:
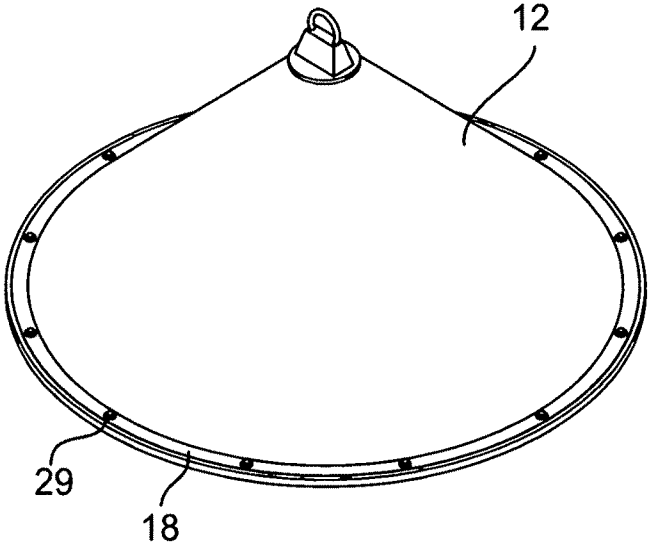
FIG. 1A is a perspective view of one exemplary embodiment of a portable apparatus for incinerating explosive material in situ.
Figure 1B:
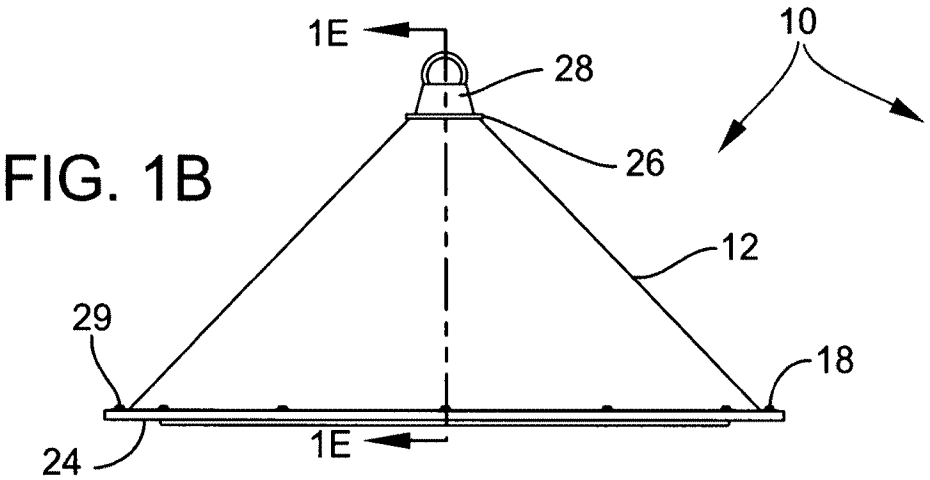
FIG. 1B is an elevation view of FIG. 1A.
Figure 1C:
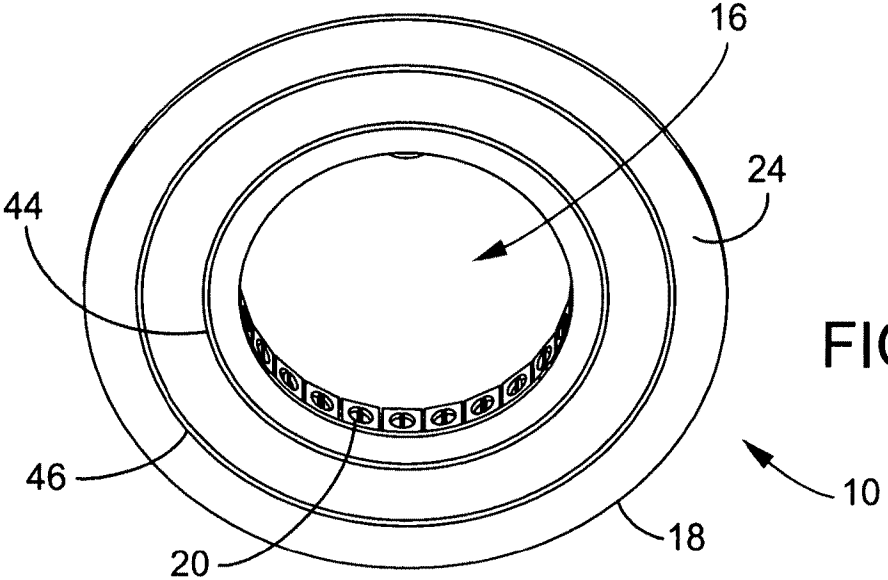
FIG. 1C is a bottom perspective view of FIG. 1A.
Figure 1D:
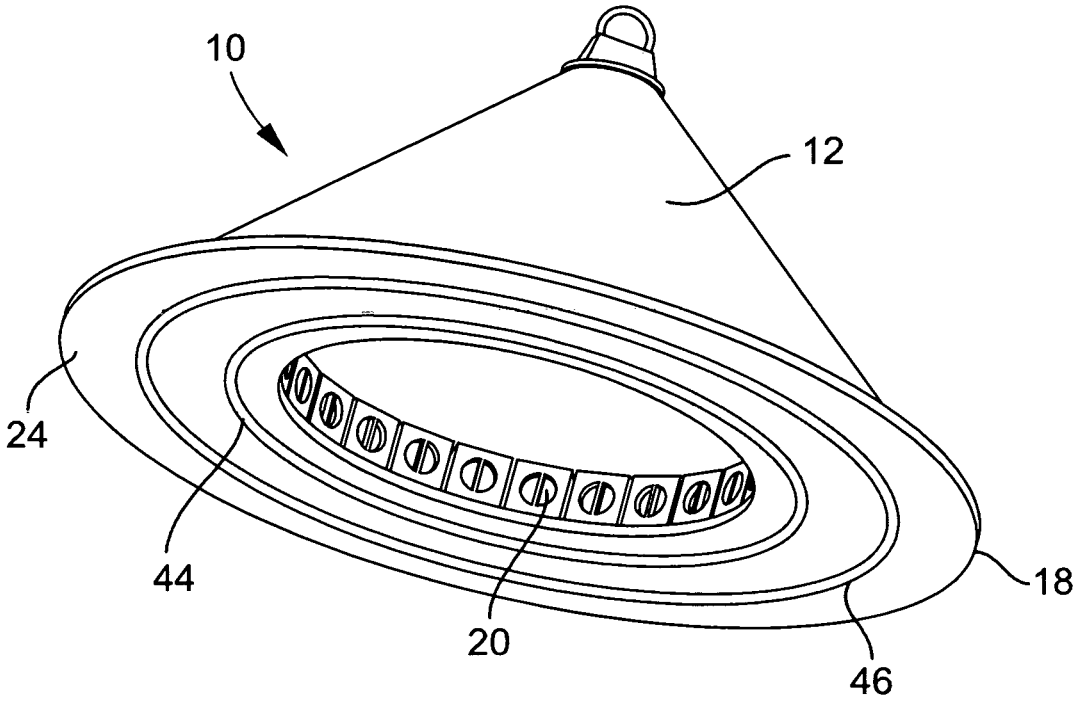
FIG. 1D is another bottom perspective view of FIG. 1A.
Figure 1E:
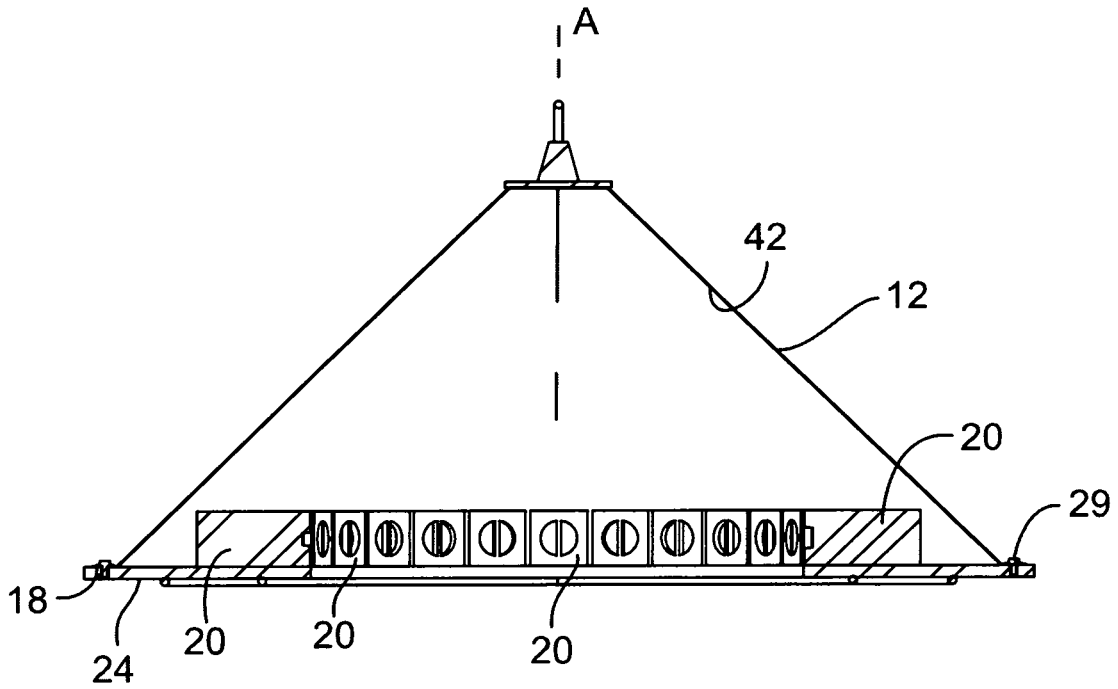
FIG. 1E is a sectional view taken along the line 1E-1E of FIG. 1B.

FIG. 1A is a perspective view of one exemplary embodiment of a portable apparatus 10 for incinerating explosive material in situ. FIG. 1B is an elevation view of FIG. 1A. FIG. 1C is a bottom perspective view of FIG. 1A. FIG. 1D is another bottom perspective view of FIG. 1A. FIG. 1E is a sectional view taken along the line 1E-1E of FIG. 1B.

Figure 2B:
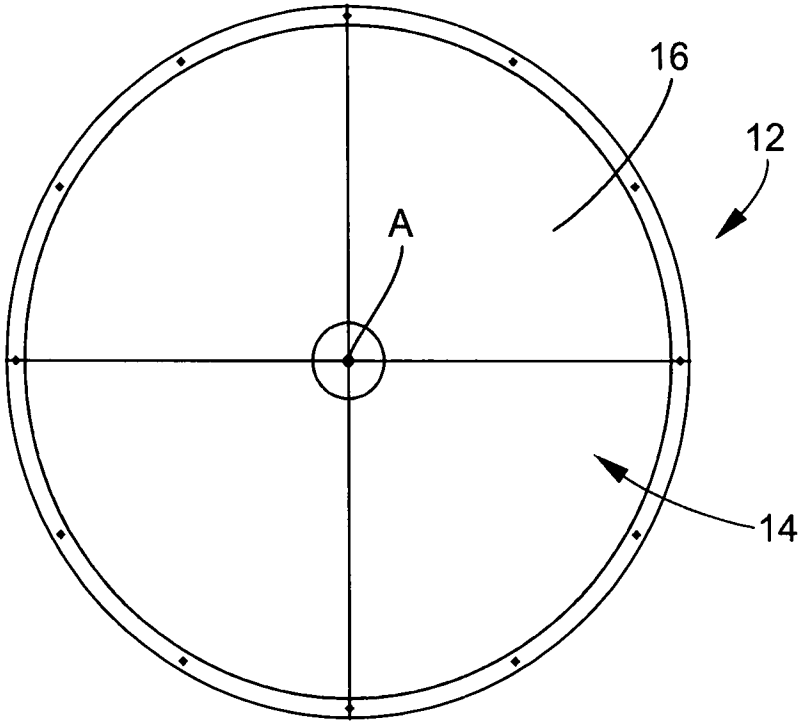
FIG. 2B is a bottom view of the container of FIG. 2A.
Figure 2A:
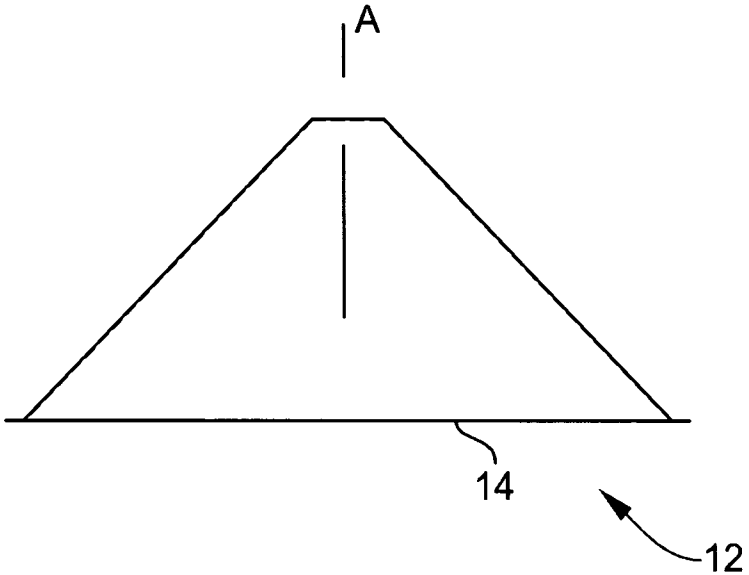
FIG. 2A is an elevation view of a container.

Apparatus 10 includes a container 12. FIG. 2A is an elevation view of an exemplary container 12. FIG. 2B is a bottom view of the container 12 of FIG. 2A. Container 12 has a central axis A and defines an open end or base 14 and an interior incineration chamber 16. Container 12 may be made of, for example, carbon steel. Open base 14 has a perimeter 18 lying in a single plane. As shown in FIGS. 2A-B, container 12 has a conical shape, but other shapes may be used. For example, container 12 may have a hemispherical or rectangular shape. In exemplary embodiments, containers having shapes with a center of mass located along a central axis and near the plane of the perimeter of the open base are generally used because the low center of mass of the container makes the container more stable when placed over matter to be incinerated. This stability is important when the matter to be incinerated is located on a surface that is highly angled with respect to the local gravity vector and or when the area around the matter to be incinerated is uneven or irregular.

Figure 1F:
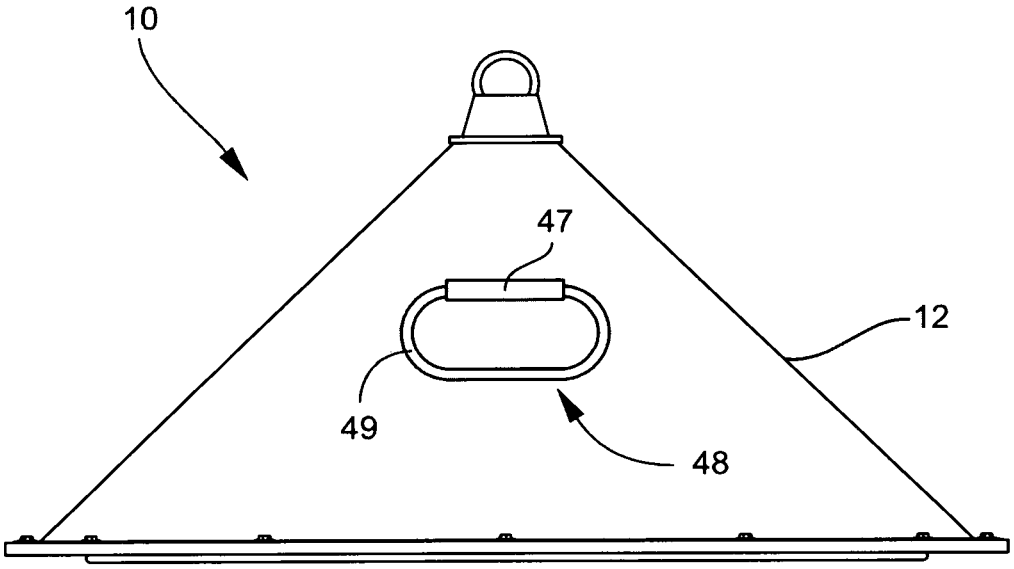
FIG. 1F is an elevation view of a portable incinerator with handles.

Referring to FIG. 1B, a hook base 26 and hook 28 may be fixed to container 12 by, for example, welding. Hook base 26 and hook 28 may be made of, for example, cast alloy steel. Hook 28 enables movement of apparatus 10. FIG. 1F is an elevation view of portable incinerator apparatus 10 with a pair of handles 48. The second handle 48 is located about 180 degrees circumferentially apart from the handle 48 that is visible in FIG. 1F. Each handle 48 may include a metal tube 47 welded to container 12. A gripper 49 is rotatably fixed in tube 47 and may be made of, for example, metal or rope. The gripper 49 is configured for gripping by a human hand.

Figure 3B:
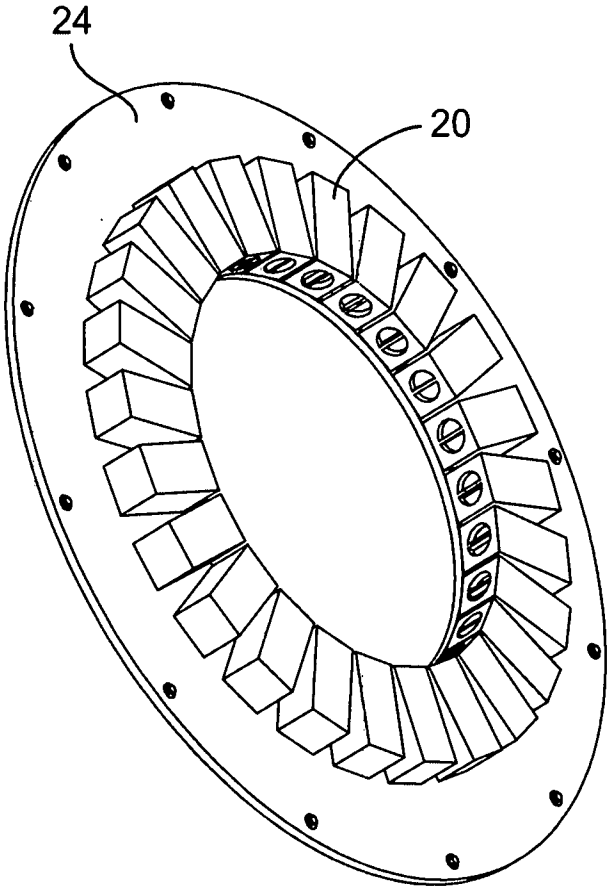
FIG. 3B is a perspective view of FIG. 3A.
Figure 3A:
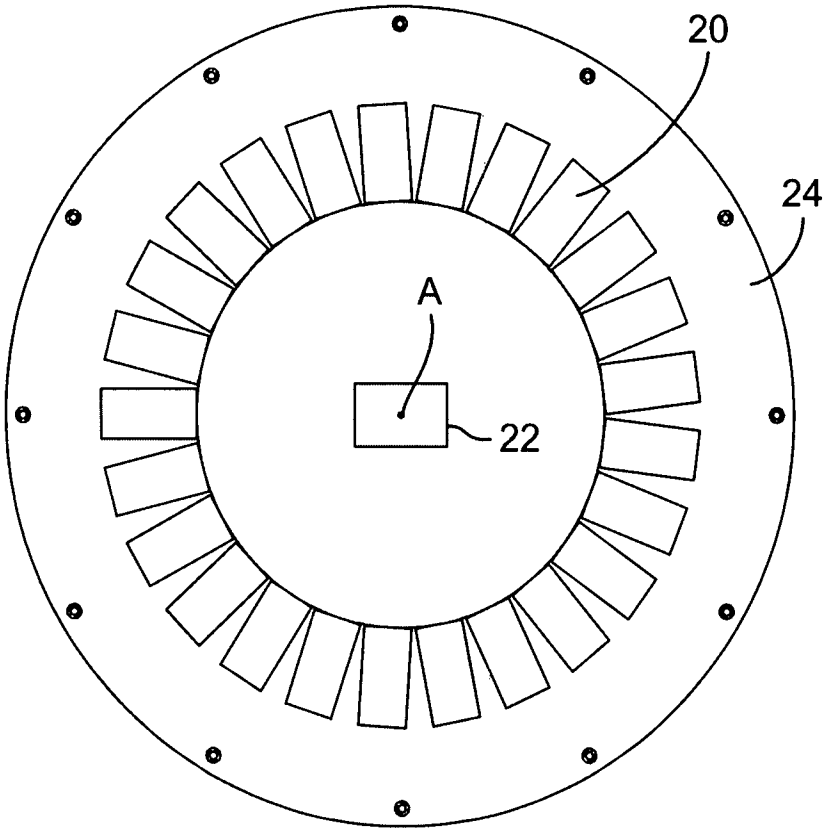
FIG. 3A is a plan view of incendiary devices pointed at matter to be incinerated.

As shown in FIG. 1E, a plurality of ignitable incendiary devices 20 are mounted in the interior incineration chamber 16 above the open base 14 and around a perimeter of the interior incineration chamber. The plurality of ignitable incendiary devices 20 are oriented such that flames produced by the incendiary devices are directed inwardly towards the central axis A. Incendiary devices 20 may be mounted on a mounting plate 24 that is fixed to container 12 using, for example, fasteners 29. As shown in plan view in FIG. 3A, when apparatus 10 is placed over matter 22 to be incinerated, incendiary devices 20 surround and point toward the matter 22. FIGS. 3A and 3B show only incendiary devices 20 mounted on plate 24 and do not show container 12 or other features of apparatus 10. In cases where the container has a shape such that planes normal to axis A are not circular, the mounting plate may still have an annular shape (e.g., rectangular annular) that is in the shape of the perimeter of the open base. The opening in the center of the annular shaped mounting plate would be centered on the central axis of the interior incineration chamber.

Matter 22 to be incinerated may be, for example, explosive material, UXO, IEDs or CBIEDs. Matter 22 is incinerated where it is found (in situ) without moving the matter. Matter 22 may be found, for example, on the ground, which may be a generally horizontal surface, an angled surface or an uneven or irregular surface.

Figure 4B:
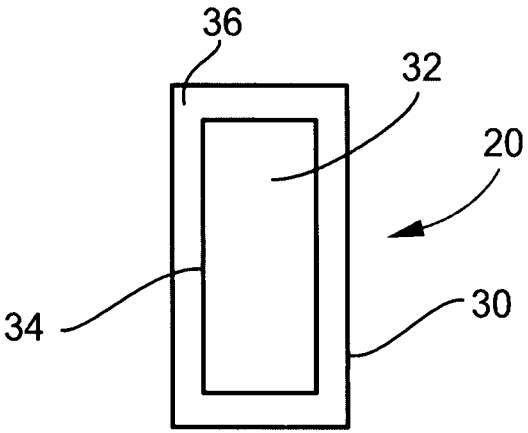
FIG. 4B is a schematic cross-sectional view of another embodiment of an ignitable incendiary device.
Figure 4A:
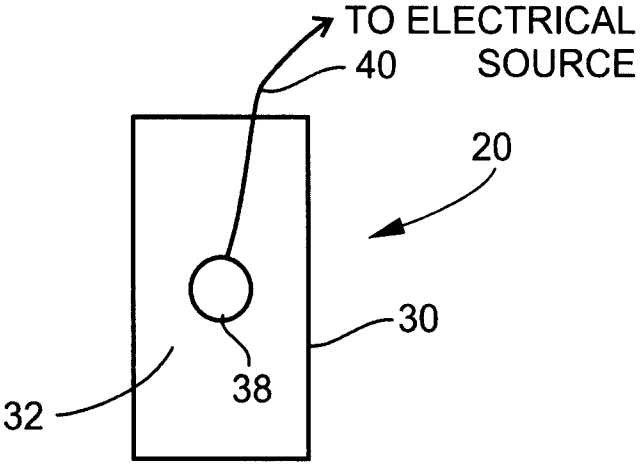
FIG. 4A is a schematic cross-sectional view of one embodiment of an ignitable incendiary device.

Incendiary devices 20 are shown in the FIGS. in the shape of a rectangular solid, but other shapes may be used, for example, square, circular, triangular, etc. As shown in FIG. 4A, in some exemplary embodiments, incendiary devices 20 may include an exterior casing 30 that is packed only with Vulcan Fire powder 32. An igniter 38, such as thermite, may be placed in one or more of the incendiary devices. An electrical initiator wire 40 may extend from the igniter 38 through a hole in container 12 (not shown) to a source of an electrical signal. In other exemplary embodiments, as shown in FIG. 4B, ignitable incendiary device 20 may include an interior casing 34 packed with Vulcan Fire powder 32. The volume between interior casing 34 and exterior casing 30 may be packed with an oxidizer 36, for example, lithium perchlorate. In some exemplary embodiments of apparatus 10, exterior casings 30 may be filled with only oxidizer 36 and may be interspersed between incendiary devices 20 filled with Vulcan Fire powder 32. One way to fix incendiary devices 20 to mounting plate 24 is to glue the bottom of the exterior casing of each incendiary device to the mounting plate using epoxy, for example. Other methods may also be used, for example, straps, etc.

Figure 5B:
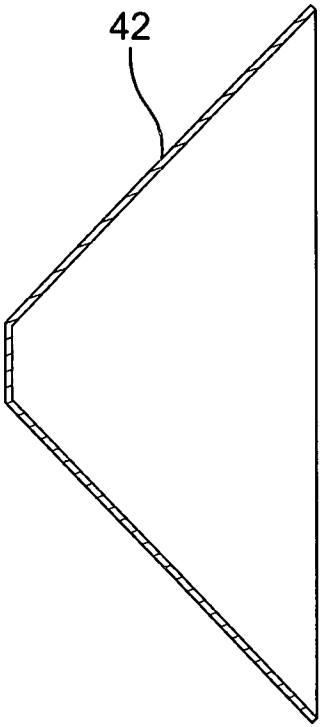
FIG. 5B is a sectional view taken along the line 5B-5B of FIG. 5A.
Figure 5A:
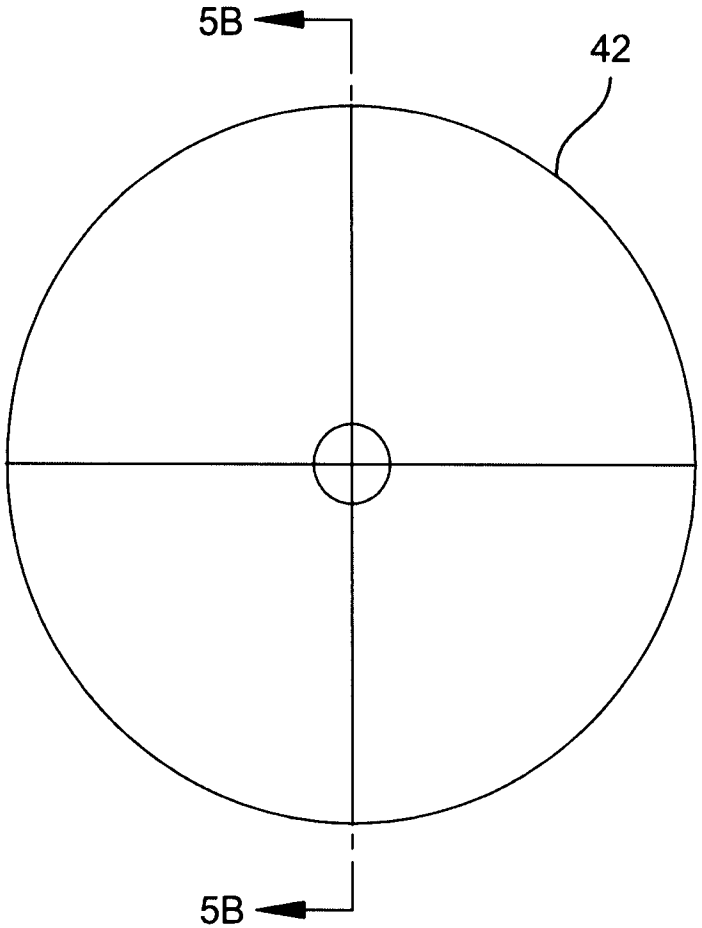
FIG. 5A is a bottom view of insulating material for the container of FIG. 2A.

The interior of container 12 may be lined with a heat-resistant material such as a rigid polyurethane foam liner 42 shown in FIGS. 5A and 5B. Other heat-resistant materials may be used, such as wool, refractory material, etc. As shown in FIGS. 1C and 1D, one or more gaskets 44, 46 may be fixed to the bottom surface of plate 24. Gaskets 44, 46 may be in the form of O-rings when the open base of container 12 is circular. Gaskets 44, 46 help create a seal between the interior incineration chamber 16 and the exterior of apparatus 10. However, a seal between the interior incineration chamber 16 and the exterior of apparatus 10 is not required for successful incineration of matter 22. Even without a seal, apparatus 10 provides sufficient containment of the thermal output of the incendiary devices 20 to neutralize, effectively matter 22. Of course, when the area around matter 22 is uneven or irregular, gaskets 44, 46 will not provide as effective a seal as when the area around matter 22 is planar.

Figure 6C:
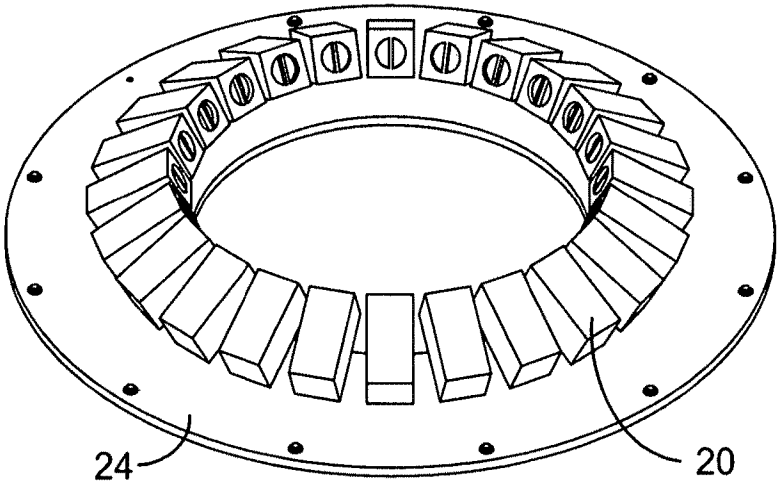
FIG. 6C is a perspective view of FIG. 6B.
Figure 6D:
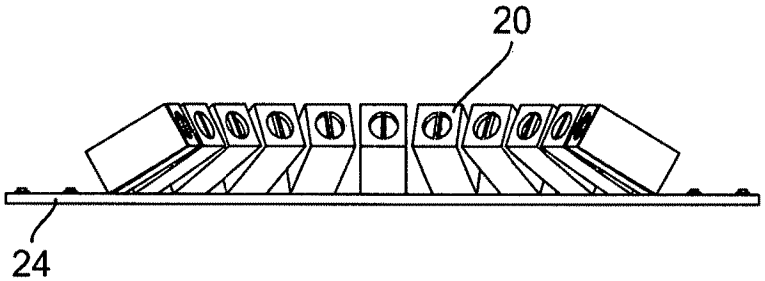
FIG. 6D is a sectional view taken along the line 6D-6D of FIG. 6B.
Figure 6A:
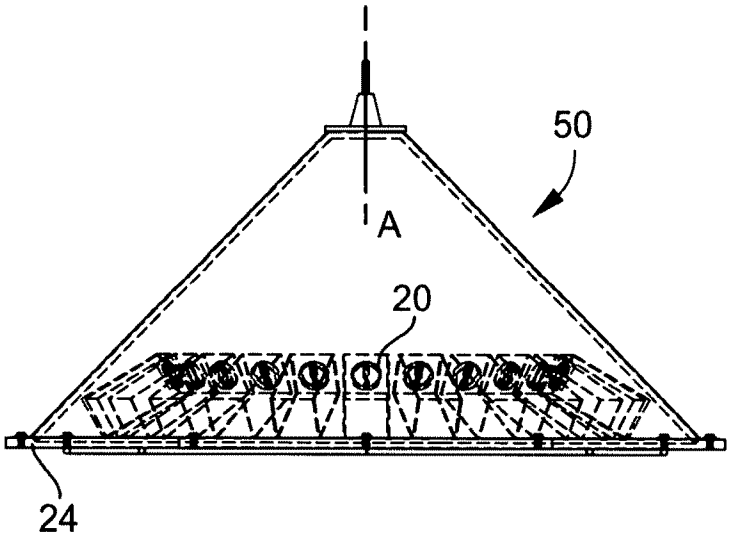
FIG. 6A is an elevation view of an exemplary embodiment of a portable apparatus for incinerating explosive material in situ with the interior components shown with dashed lines.
Figure 6B:
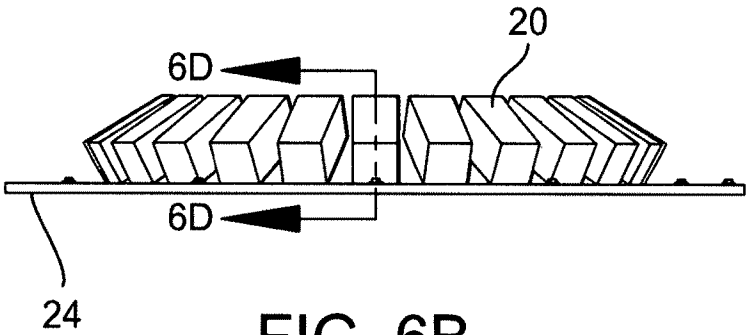
FIG. 6B is an elevation view of only the mounting plate and incendiary devices of the apparatus of FIG. 6A.

In the exemplary embodiment shown in FIGS. 1E, 3A and 3B, all incendiary devices 20 are pointed inwardly toward central axis A in a direction parallel to the plane of the open base 14 and mounting plate 24. In some embodiments, the incendiary devices 20 may be pointed inwardly toward central axis A in a direction that is angled upward with respect to the plane of the open base 14 and mounting plate 24. FIG. 6A is an elevation view of an exemplary embodiment of a portable apparatus 50 for incinerating explosive material in situ with the interior components shown with dashed lines. FIG. 6B is an elevation view of only the mounting plate 24 and incendiary devices 20 of the apparatus of FIG. 6A. FIG. 6C is a perspective view of FIG. 6B. FIG. 6D is a sectional view taken along the line 6D-6D of FIG. 6B. The angle between incendiary devices 20 and the mounting plate 24 shown in FIGS. 6A-D is thirty degrees. Other angles may be used, such as, for example, from zero degrees to about forty-five degrees. The incendiary devices 20 may be angled with respect to the mounting plate 24 so that the thermal output of the incendiary devices is aimed directly at the matter 22 to be incinerated. The angled devices 20 may direct greater thermal effect onto the matter 22 to ensure a higher probability of neutralization. The angle may be adjusted for the height of the matter 22.

Figure 6E:
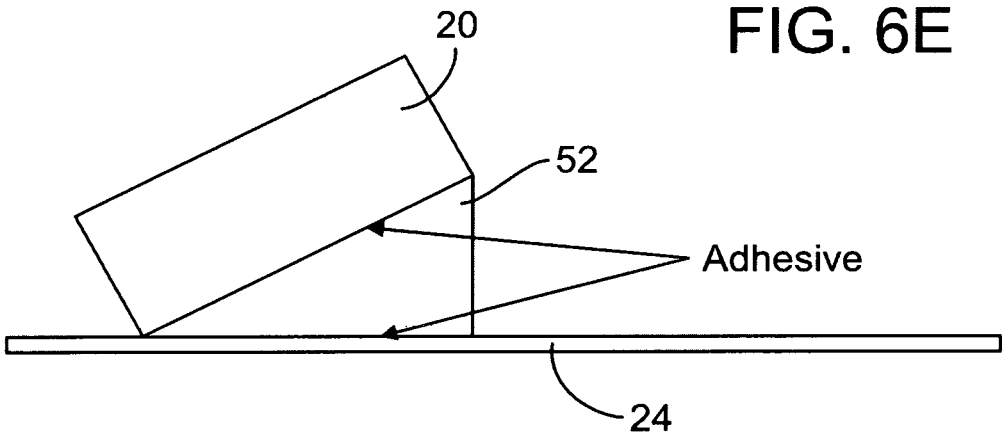
FIG. 6E is a side view illustrating a mounting method for an angled incendiary device.
Figure 6F:
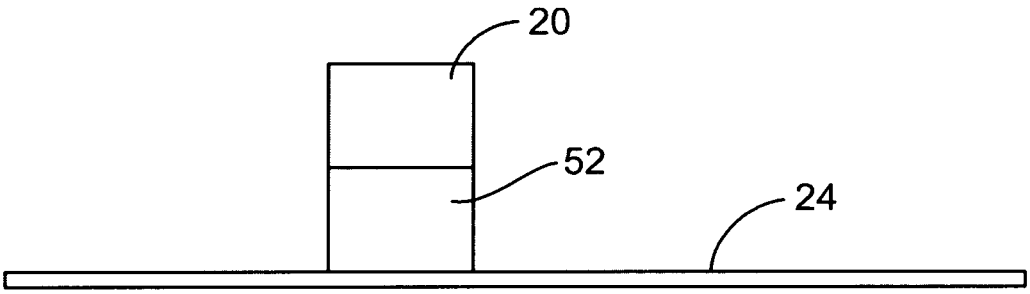
FIG. 6F is a front view of FIG. 6E.

FIG. 6E is a side view illustrating a mounting method for an angled incendiary device 20. FIG. 6F is a front view of FIG. 6E. In this mounting method, a wedge 52 is glued to the mounting plate 24 and to the bottom of the external casing of device 20 using, for example, epoxy. Wedge 52 may be made of, for example, wood or phenolic types of materials.

In some embodiments, some of the incendiary devices 20 may be pointed inwardly toward axis A in a direction parallel to the plane of the open base 14 and the mounting plate 24, and the remainder of the incendiary devices 20 may be pointed inwardly toward axis A in a direction that is angled upward with respect to the plane of the open base 14 and the mounting plate 24.

Figure 7C:
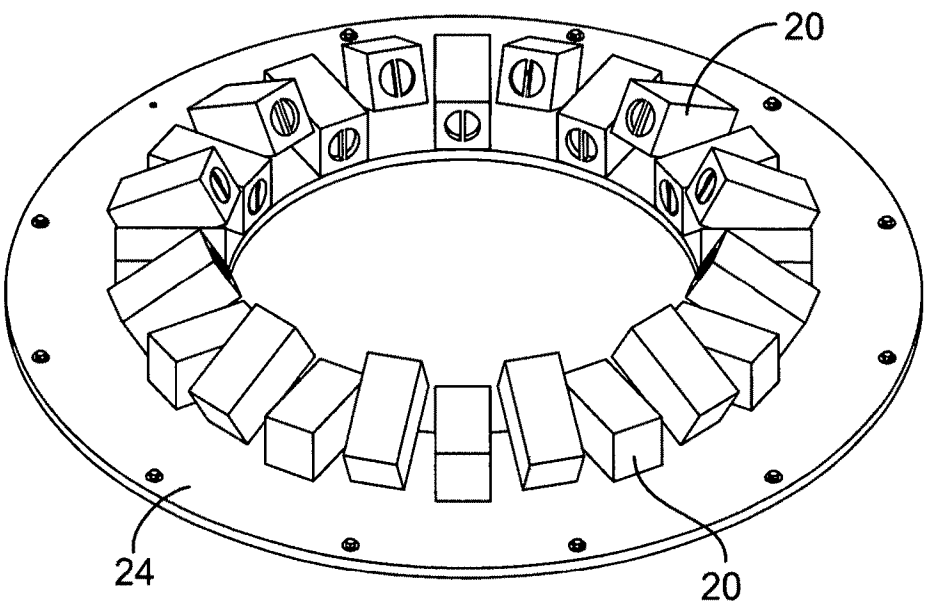
FIG. 7C is a perspective view of FIG. 7B.
Figure 7D:
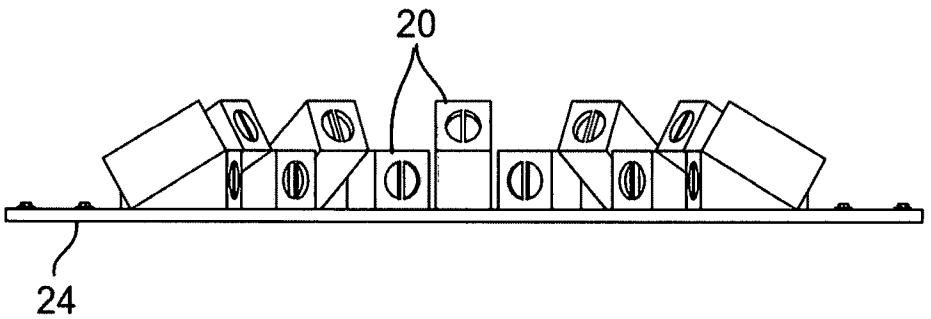
FIG. 7D is a sectional view taken along the line 7D-7D of FIG. 7B.
Figure 7A:
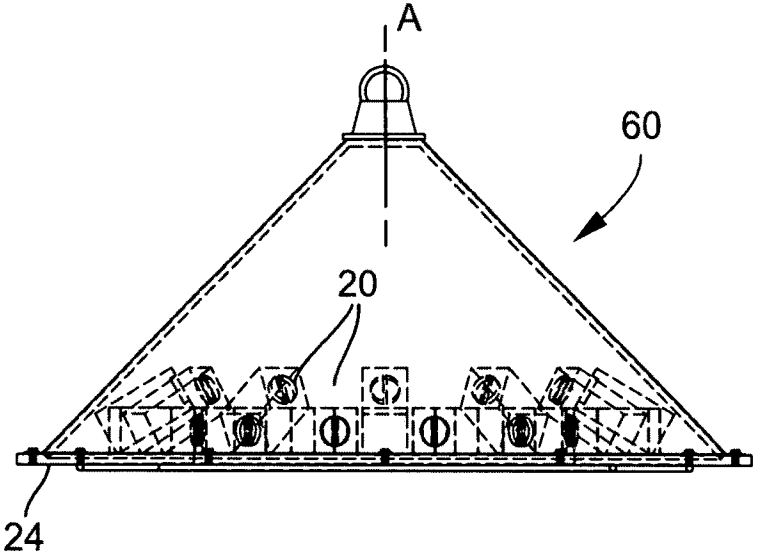
FIG. 7A is an elevation view of an exemplary embodiment of a portable apparatus for incinerating explosive material in situ with the interior components shown with dashed lines.
Figure 7B:
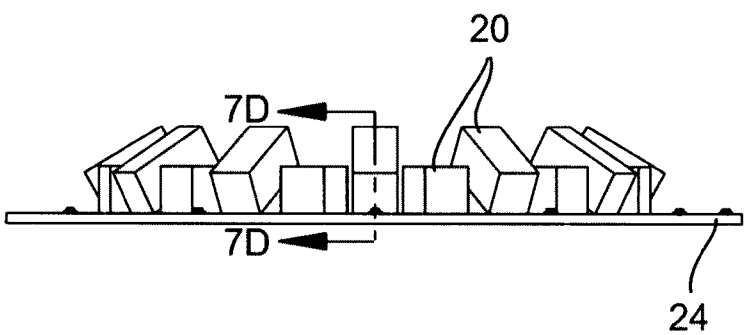
FIG. 7B is an elevation view of only the mounting plate and incendiary devices of the apparatus of FIG. 7A.

FIG. 7A is an elevation view of an embodiment of a portable apparatus 60 for incinerating explosive material in situ with the interior components shown with dashed lines. FIG. 7B is an elevation view of only the mounting plate 24 and incendiary devices 20 of the apparatus 60. FIG. 7C is a perspective view of FIG. 7B. FIG. 7D is a sectional view taken along the line 7D-7D of FIG. 7B. The angle between the angled incendiary devices 20 in FIGS. 7A-D and the mounting plate 24 is thirty degrees. Other angles may be used, such as from zero degrees to about forty-five degrees. The devices 20 are arranged so that the angled and non-angled devices 20 alternate around the plate 24. The angled and non-angled devices 20 may be fixed to mounting plate 24 as described with respect to apparatus 10 and 50. The use of both non-angled and angled incendiary devices 20 in the same incendiary apparatus is useful because angling some incendiary devices at higher and lower angles creates an expanded thermal neutralization zone. As the matter 22 is burned by the incendiary devices, the burning products will rise in apparatus 60. The higher angled incendiary devices will attack agents that rise above the lower thermal neutralization zone. Also, if the matter 22 is relatively tall, the use of some incendiary devices pointed at a low angle and some at higher angles will provide better thermal coverage of the matter to be incinerated.

For a two-person portable embodiment of a conical apparatus 10, 50 or 60, the diameter of the base of container 12 may be in a range of about 18 inches to about 36 inches.

A method of incinerating matter in situ includes providing an apparatus such as apparatus 10. The apparatus 10 is placed over the matter 22 to be incinerated such that the apparatus 10 rests on the area surrounding the matter and the open base 14 of the container 10 is centered over the matter. In that position of apparatus 10, the ignitable incendiary devices 20 will be pointing toward the axis A of the apparatus 10 and the matter 22. The incendiary devices 20 may be ignited by an electrical signal. The extreme heat directed to matter 22 incinerates the matter leaving a harmless ceramic slug.

Any numerical parameters set forth in the specification and attached claims are approximations that may vary depending upon the desired properties sought to be obtained by the present invention. At the very least, and not as an attempt to limit the application of the doctrine of equivalents to the scope of the claims, each numerical parameter should at least be construed in light of the number of significant digits and by applying ordinary rounding.

What is claimed is:

1. A portable apparatus for incinerating matter in situ, comprising:

a container defining an open base and an interior incineration chamber, wherein the open base includes a perimeter lying in a single plane; and a plurality of ignitable incendiary devices being mounted in the interior incineration chamber above the open base and around a perimeter of the interior incineration chamber, wherein the plurality of ignitable incendiary devices are oriented such that flames produced by the incendiary devices are directed inwardly towards a central axis of the incineration chamber, and wherein the plurality of incendiary devices are configured to surround and point toward the matter to be incinerated.

2. The portable apparatus of claim 1, further comprising a hook being fixed to the container for moving the portable apparatus.

3. The portable apparatus of claim 1, wherein each of the plurality of ignitable incendiary devices includes a first casing containing Vulcan Fire powder.

4. The portable apparatus of claim 3, wherein each of the incendiary devices further includes an oxidizer in a second casing surrounding the first casing.

5. The portable apparatus of claim 3, further comprising third casings being filled with oxidizer, wherein the third casings are interspersed between the plurality of incendiary devices.

6. The portable apparatus of claim 3, wherein each of the incendiary devices further includes an oxidizer in a second casing surrounding the first casing, and wherein the oxidizer is lithium perchlorate.

7. The portable apparatus of claim 3, further comprising third casings being filled with oxidizer, wherein the third casings are interspersed between the plurality of incendiary devices, and wherein the oxidizer is lithium perchlorate.

8. The portable apparatus of claim 3, wherein the plurality of incendiary devices are pointed in a direction parallel to the single plane of the open base.

9. The portable apparatus of claim 3, wherein the plurality of incendiary devices are pointed in a direction that is angled upward with respect to the single plane of the open base.

10. The portable apparatus of claim 3, wherein some of the plurality of incendiary devices are pointed in a direction parallel to the single plane of the open base and a remainder of the plurality of incendiary devices are pointed in a direction that is angled upward with respect to the single plane of the open base.

11. The portable apparatus of claim 3, further comprising a plate being fixed to the container, wherein the plurality of ignitable incendiary devices are mounted to the plate.

12. The portable apparatus of claim 3, further comprising a plate being fixed to the container, wherein the plurality of ignitable incendiary devices are mounted to the plate, and wherein the plate includes an annular shape in a shape of the perimeter of the open base and an opening of the annular shape is centered on the central axis of the interior incineration chamber.

13. The portable apparatus of claim 3, further comprising a plate being fixed to the container, wherein the plurality of ignitable incendiary devices are mounted to the plate, and wherein the plate includes an annular shape in a shape of the perimeter of the open base and an opening of the annular shape is centered on the central axis of the interior incineration chamber; and a gasket being fixed to a bottom of the plate and extending around the opening of the annular shape.

14. The portable apparatus of claim 3, further comprising a plate being fixed to the container, wherein the plurality of ignitable incendiary devices are mounted to the plate, wherein the plate includes an annular shape in a shape of the perimeter of the open base and an opening of the annular shape is centered on the central axis of the interior incineration chamber, and wherein the container includes a conical shape, the perimeter of the open base is circular, and the plate is a circular annulus.

15. The portable apparatus of claim 1, wherein the matter incinerated is an improvised explosive device.

16. The portable apparatus of claim 1, wherein the interior incineration chamber is lined with a heat-resistant material.

17. A method of incinerating matter in situ, comprising:

providing a container defining an open base and an interior incineration chamber, the open base includes a perimeter lying in a single plane;

providing a plurality of ignitable incendiary devices being mounted in the interior incineration chamber above the open base and around a perimeter of the interior incineration chamber, wherein the plurality of ignitable incendiary devices are oriented such that flames produced by the incendiary devices are directed inwardly towards a central axis of the incineration chamber; and placing the open base of the container over the material being incinerated in situ such that the central axis of the chamber is configured to intersect with the material being incinerated.

18. The method of claim 17, further comprising igniting the plurality of ignitable incendiary devices.

19. The method of claim 18, wherein said igniting the plurality of ignitable incendiary devices includes sending an electrical signal to an electrically initiated ignitor.

20. The method of claim 18, further comprising incinerating the matter being incinerated in situ, wherein said igniting the plurality of ignitable incendiary devices includes sending an electrical signal to an electrically initiated ignitor.

* * * * *